US007050598B1

(12) United States Patent
Ham

(10) Patent No.: US 7,050,598 B1
(45) Date of Patent: May 23, 2006

(54) SELF-ADJUSTING EARLOOP FOR AN OVER-THE-EAR HEADSET

(75) Inventor: Soohyun Ham, Santa Cruz, CA (US)

(73) Assignee: Plantronics, Inc., Santa Cruz ( * ) Notice: Subject to any disclaimer, the term of this patent is extended or adjusted under 35 U.S.C. 154(b) by 40 days.

(21) Appl. No.: 10/313,730

(22) Filed: Dec. 6, 2002

(51) Int. Cl.
*H04R 25/00* (2006.01)

(52) U.S. Cl. ..... 381/381; 381/330; 381/374

(58) Field of Classification Search ..... 381/370, 381/371, 374, 375, 376, 381, 330, 377, 378, 381/379; 379/430; 181/128, 129, 135
See application file for complete search history.

(56) References Cited

U.S. PATENT DOCUMENTS 5,260,997 A * 11/1993 Gattey et al. ..... 379/430
5,450,496 A * 9/1995 Burris et al. ..... 381/375
5,708,724 A * 1/1998 Burris et al. ..... 381/370
6,449,374 B1 9/2002 Skulley et al.

OTHER PUBLICATIONS

WEBSTER'S Ninth New Collegiate Dictionary, p. 628.*
Bluetooth Wireless Headset, User's Manual, ATA Technology, United States of America.
Bluetooth Headset, Web Page URL: http://www.atotechnology.com/html/Bt20.html, ATO Technology, Date: 2002, Hong Kong, China.

* cited by examiner

*Primary Examiner*—Huyen Le
(74) *Attorney, Agent, or Firm*—Jung-hua Kao

(57) ABSTRACT

Conformable spring-loaded earloops for over-the-ear style headsets are disclosed. The earloop for a headset generally comprises a prehensile member having a connecting member and a stabilizer portion and a ring integrally formed with and extending from the connecting member. The stabilizer portion is adapted to curve at least partially around and behind an ear to clip onto the ear in substantially a first plane. The ring is configured to removably receive and rotatably secure a receiver capsule of a headset therein and to direct the receiver capsule toward a concha of the ear. The prehensile member and the ring define an open-ended curved space to facilitate donning of the earloop. Upon application of an external force, the stabilizer portion is resiliently adjustable relative to the ring out of the first plane toward and away from the ear and/or in the first plane toward and away from the ring. The stabilizer portion returns to a static resting state configuration upon removal of external forces. The stabilizer portion has a larger cross-sectional dimension than the connecting member to facilitate the connecting member in functioning as a hinge for resiliently adjusting the stabilizer portion. The earloop further provides for adjusting the height between a center of the ring and the point along an interior surface of the stabilizer portion that rests upon the apex of the ear when worn. At least some of the inner portion of the stabilizer portion may be an elastomeric material.

39 Claims, 8 Drawing Sheets

SELF-ADJUSTING EARLOOP FOR AN OVER-THE-EAR HEADSET

BACKGROUND OF THE INVENTION

1. Field of the Invention

The present invention relates generally to headsets for use in telecommunications and telephony. More specifically, conformable spring-loaded earloops for over-the-ear style headsets are disclosed.

2. Description of Related Art

Communication headsets are used in numerous applications and are particularly effective for telephone operators, radio operators, aircraft personnel, and for other individuals for whom it is desirable to have hands free operation of communication systems. Accordingly, a wide variety of conventional headsets are available.

One type of communication headset is a monaural headset. Monaural headsets are headsets that have only a single audio receiver for placement near one ear. Often, such headsets are implemented with an earloop that is configured to fit around the ear to secure the receiver in place. Such headsets may be very compact.

However, because of the large natural variations in the size, shape, and orientation of human ears, over-the-ear style headsets often do not fit properly for many potential users. For example, earloops often do not fit snugly and thus are not stable and earloops may not be comfortable for a large spectrum of potential users. In addition, the ergonomic goals of stability and comfort are often in conflict since a snug fit that provides a secure attachment for the headset often pinches the ear or creates pressure points that are uncomfortable for many users, particularly when the headset is worn for an extended period of time. In addition, a snug fit precludes the ability for the user to easily don and doff the headset with only one hand.

Some conventional earloops utilize hard, extendible pieces to lengthen the earloop behind the ear lobe. Others conventional earloops use small, pivotable flippers to close the gap behind the ear. However, these earloops typically have fixed contours with either no or limited predetermined ranges of motion and shape that only fit a fraction of the population of users. Consequently, they are not comfortable for many users and do not provide a secure fit.

Other conventional earloops employ molded, rubber-like material, either alone or reinforced with metal wire inserts. Unfortunately, the rubber earloops often stretch, allowing the earloop to slide or rotate about the ear. Moreover, wire reinforced designs often fatigue and break with continuous use, reducing the useful life of the headset. In addition, such earloops generally require two-hand fitting by the user and must be squeezed tightly and bent into shape in order to provide a sufficient level of clamping force. Removing the installed earloop usually results in distortion of its previous wearing shape and requires the user to reshape the earloop each time that it is worn.

Accordingly, what is needed is an earloop that provides a snug and secure fit for a wide variety of ear shapes, sizes, and orientations that is comfortable to be worn for extended periods of time and that can be easily donned and positioned on the ear with only one hand.

SUMMARY OF THE INVENTION

Conformable spring-loaded earloops for over-the-ear style headsets are disclosed. It should be appreciated that the present invention can be implemented in numerous ways, including as a process, an apparatus, a system, a device, a method, or a computer readable medium such as a computer readable storage medium or a computer network wherein program instructions are sent over optical or electronic communication lines. Several inventive embodiments of the present invention are described below.

The earloop for a headset generally comprises a prehensile member having a connecting member and a stabilizer portion and a ring integrally formed with and extending from the connecting member. The stabilizer portion is adapted to curve at least partially around and behind an ear to clip onto the ear in substantially a first plane. The ring is configured to removably receive and rotatably secure a receiver capsule of a headset therein and to direct the receiver capsule toward a concha of the ear. The ring is also configured to receive the receiver capsule of the headset in either of two opposing configurations so as to enable the user to wear the headset on either the left or the right ear. The prehensile member and the ring define an open-ended curved space to facilitate donning of the earloop. Upon application of an external force, the stabilizer portion is resiliently adjustable relative to the ring out of the first plane toward and away from the ear and/or in the first plane toward and away from the ring. The stabilizer portion returns to a static resting state configuration upon removal of external forces. The stabilizer portion has a larger cross-sectional dimension than the connecting member to facilitate the connecting member in functioning as a hinge for resiliently adjusting the stabilizer portion. The earloop further provides for adjusting the height between a center of the ring and the point along an interior surface of the stabilizer portion that rests upon the apex of the ear when worn. At least some of the inner portion of the stabilizer portion may be an elastomeric material.

Preferably, the ring provides protuberances, such as teeth and/or arcuate ridges, along its interior perimeter to correspond to and mate with a corresponding channel, optionally provided with corresponding teeth, defined in the receiver capsule. The earloop may further include an intertragal notch cover coupled to the ring and disposed to at least partially cover an intertragal notch of the ear. The intertragal notch cover is preferably resiliently movable out of the first plane toward and away from the intertragal notch of the ear.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF SPECIFIC EMBODIMENTS

Figure 1A:
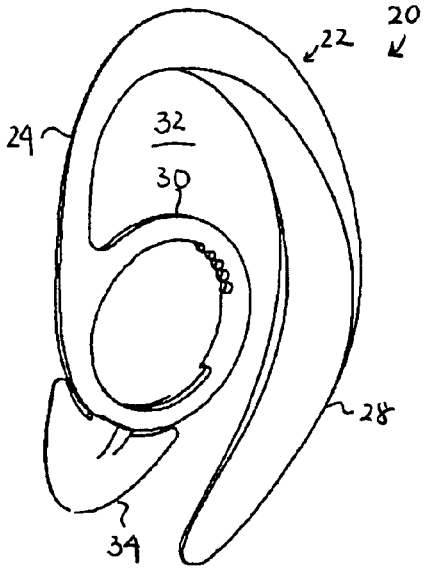
FIG. 1A is a perspective view of an earloop for use in a headset.

Conformable spring-loaded earloops for over-the-ear style headsets are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

FIGS. 1A–1D are a perspective view, a plan view, a top view, and a front view, respectively, of an exemplary embodiment of an earloop 20 for use in a headset with a headset body (not shown). The earloop 20 shown in each of in FIGS. 1A–1D is in a substantially static (resting) state in which no external force is applied thereto. The earloop 20 generally includes a prehensile member 22 having a connection arm 24 and a behind-the-ear stabilizer portion 28. The prehensile member 22 provides an aperture such as a snap ring 30 adapted to receive a receiver (speaker) capsule of the headset body therein. The connection arm 24 connects the snap ring 30 to the behind-the-ear stabilizer portion 28 of the prehensile member 22. The snap ring 30 is adapted to receive and cooperate with the receiver capsule of the headset body. As will be described in more detail below, the headset body, i.e., an audio receiver/transmitter assembly, typically includes the receiver capsule and a transmitter, such as a boom microphone or sound tube, for example.

The earloop 20 is configured such that the snap ring 30 and the receiver capsule of the headset body are generally positioned at the entrance to the ear canal when the headset is worn by a user. In other words, the ring 30 is positioned such that when the headset is worn, the ring 30 is slightly rested in the concha of the ear so as to direct the receiver of the headset into the concha of the ear. The ring may be positioned under a concha wall to create a slight spring tension with the prehensile member to securely stabilize a headset. In one preferred embodiment, the outer diameter of the ring 30 may be approximately 21 mm and the inner diameter of the ring 30 may be approximately 17 mm. The receiver capsule is adapted to at least partially extend into the concha of the ear. The size of the ring 30 facilitates in positioning the receiver capsule of the headset body closer to the entrance to the ear canal. As is evident, positioning the receiver capsule closer to the entrance to the ear canal results in a louder sound to the user for a given signal output by the speaker of the headset receiver. In addition, the receiver capsule being closer to the entrance to the ear canal may also increase the stability of the headset when worn.

The prehensile member 22 may optionally provide an intertragal notch cover 34 extending from the snap ring 30 to provide added acoustic sealing for the receiver capsule and/or to provided additional stability to the earloop 20 when worn. When the earloop 20 is worn on the user's ear, the intertragal notch cover 34 is preferably configured and positioned to at least partially cover the intertragal notch, i.e., the notch separating the tragus from the antitragus of the ear.

Figure 1B:
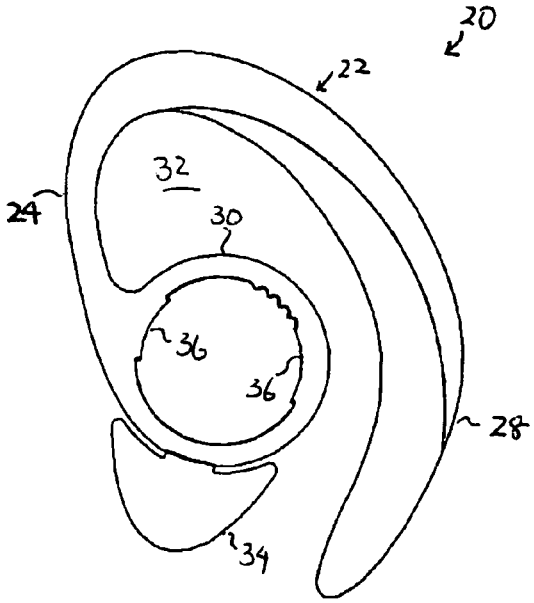
FIG. 1B is a plan view of the earloop of FIG. 1A for use in a headset.
Figure 1C:
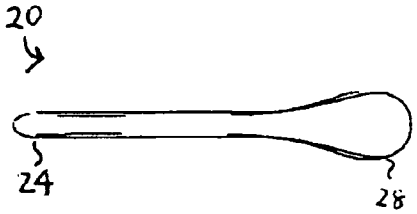
FIG. 1C is a top view of the earloop of FIG. 1A for use in a headset.
Figure 1D:
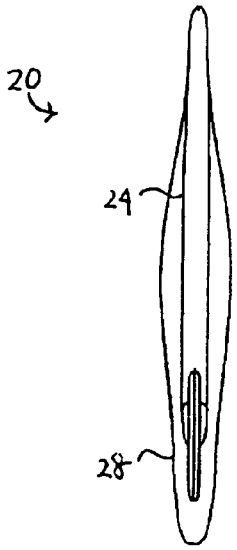
FIG. 1D is a front view of the earloop of FIG. 1A for use in a headset.

As shown in FIGS. 1A and 1B, the snap ring 30 may provide one or more arcuate ridges or protuberances 36 on an inner perimeter or surface thereof that correspond to and mate with a corresponding channel provided in the receiver capsule of the headset body. The arcuate ridges 36 and the receiver capsule channel work together to removably secure and hold the headset body to the earloop 20. When the receiver capsule of the headset body is secured to the snap ring 30, the arcuate ridges 36 of the snap ring 30 ride within the shallow channel of the receiver capsule as the headset body is rotated relative to the snap ring 30 and the earloop 20. In addition, the arcuate ridges 36 also enable the receiver capsule to be easily snapped onto and off the snap ring 30 and provide tactile and/or audible feedback when the receiver module is snapped onto and off the snap ring 30. The ring 30 is configured to receive the receiver capsule of the headset in either of two opposing configurations so as to enable the user to wear the headset on either the left or the right ear. In one preferred embodiment, the arcuate ridges 36 and/or the channel defined in the receiver capsule are dimensioned so as to have a frictional fit therebetween that is sufficient to maintain the orientation of the headset body relative to the ring 30 and the earloop 20 so as to allow the user to selectively position the headset body for optimal performance of the headset.

Figure 1E:
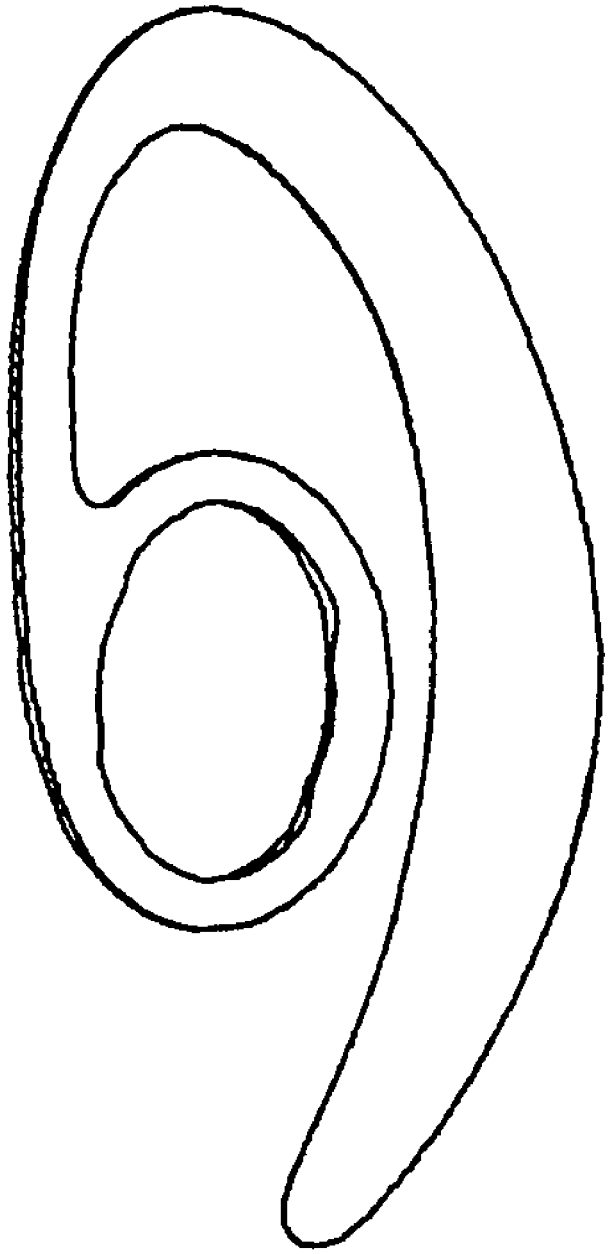
FIG. 1E is a perspective view of an alternative embodiment of the earloop shown without an intertragal notch cover and formed of a single material.

FIG. 1E is a perspective view of an alternative embodiment of the earloop shown without an intertragal notch cover and prehensile member being formed of a single material.

Figure 2:
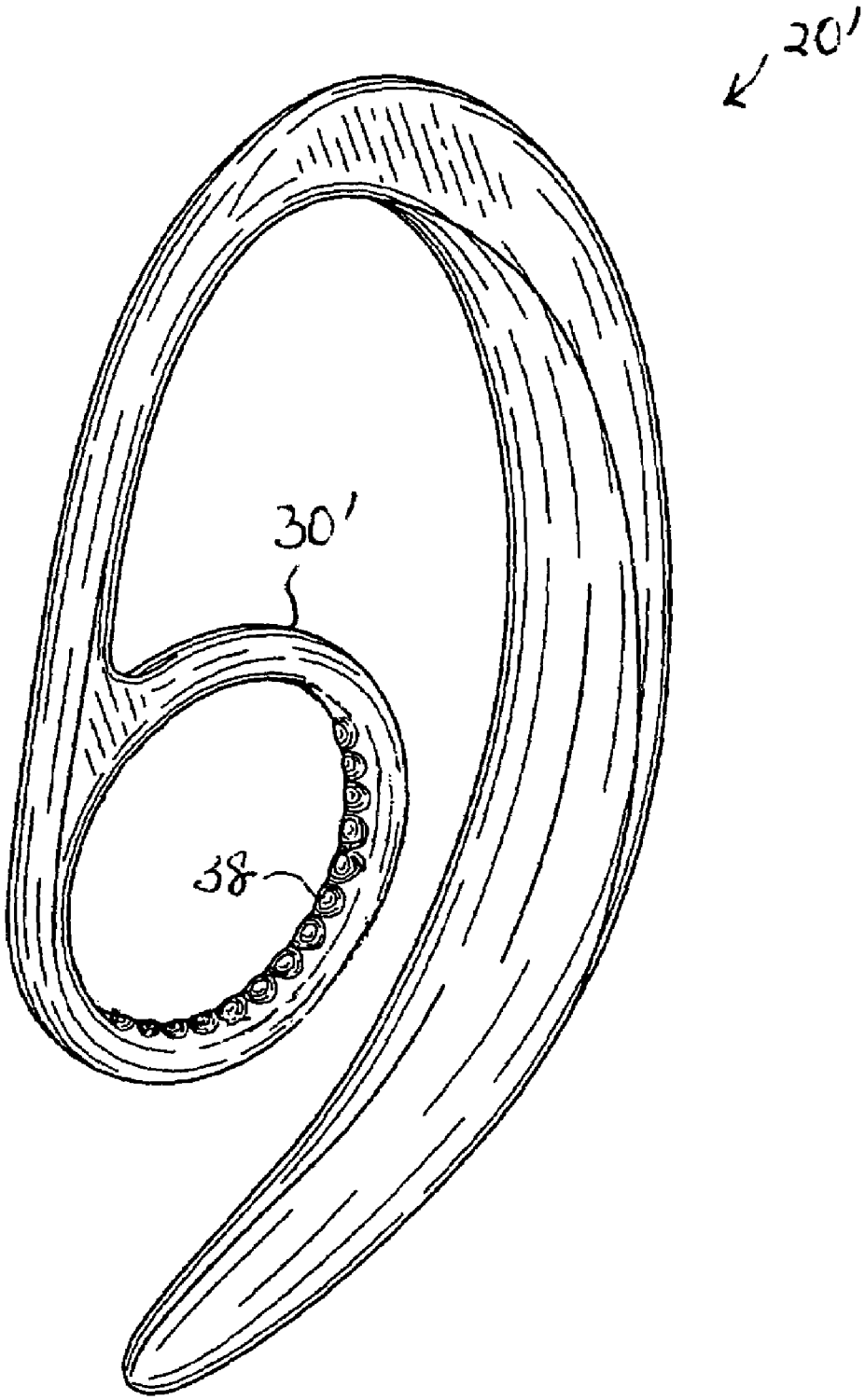
FIG. 2 is a perspective view of another alternative embodiment of the earloop.

Alternatively or additionally, small teeth may be provided by the snap ring 30 an/or the channel of the receiver capsule to as to provide a ratchet mechanism to enable definite and/or fine adjustment between the headset body and the snap ring 30 as will be described below with reference to FIG. 2. Specifically, FIG. 2 is a perspective view of an alternative embodiment of the earloop 20' in which the snap ring 30' provides small teeth 38 disposed around at least a portion of the inner perimeter of the snap ring 30'. The teeth 38 correspond to and mate with a corresponding channel provided in the receiver capsule of the headset body. The teeth 38 and the receiver capsule channel work together to secure and hold the headset body to the earloop 20'. In particular, when the receiver capsule of the headset body is secured to the snap ring 30', the teeth 38 of the snap ring 30' ride within the shallow channel of the receiver capsule as the headset body is rotated relative to the snap ring 30' and the earloop 20'. In addition, the teeth 38 also enable the receiver capsule to be easily snapped onto and off the snap ring 30' and to provide tactile and/or audible feedback when the receiver module is snapped onto and off the snap ring 30'.

The channel defined in the receiver capsule may also provide teeth similar to the ring teeth 38 along at least a portion of the perimeter of the channel. The teeth within the ring and the channel are preferably spaced and sized such that the two sets of teeth are offset from and in contact with each other when the headset body is secured to the earloop 20'. Thus, the two sets of teeth also provide positive tactile and/or audible feedback as the headset body is rotated relative to the ring 30'. In addition, the two sets of teeth cooperate to provide positive stops as the headset body is rotated relative to the snap ring 30' and thereby facilitate in maintaining the orientation of the headset body relative to the snap ring 30' and the earloop 20' so as to enable the user to selectively position the headset body for optimal performance of the headset.

Figure 3:
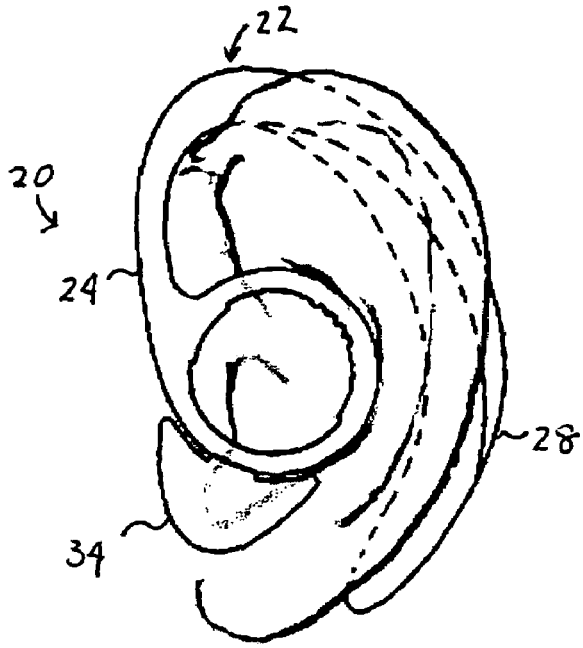
FIG. 3 is a plan view of the earloop of FIG. 1A as worn on an ear.

The prehensile member 22 is adapted to at least partially wrap around and behind the ear of the user in a plane substantially vertical to the plane of the ear, as illustrated in the perspective view of the earloop 20 as worn on the ear in FIG. 3. As will be described in further detail below, the earloop 20 is configured and shaped to be easily and intuitively donned and worn on the ear and easily and intuitively taken off of the ear. When worn, the headset generally hangs from the apex of the ear and clips around and behind the ear. Thus, as the earloop 20 enables the headset to be hung and clipped onto the ear, the pressure from the weight of the headset is more evenly distributed around the ear.

Referring again to FIGS. 1A–1C, an inner portion of the connecting arm 24 and the behind-the-ear portion 28 of the prehensile member 22, on the one hand, and the snap ring 30, on the other hand, define an open-ended curved space 32 therebetween. The earloop 20 is shaped and configured such that the open-ended curved space 32 facilitates in having a portion of the user's ear positioned therein when the earloop 20 is worn by the user. At least some of the inner portion of the prehensile member 22 is curved or contoured as determined by the contours over and behind the ear. The inner portion of the prehensile member 22 preferably has an approximately arcuate shape to facilitate wrapping and positioning the prehensile member 22 over and behind the ear and to facilitate wrapping and seating the inner portion of the prehensile member 22 on the ear.

The curved space 32 preferably is configured and sized such that the earloop 20 exerts a positive tension (spring action) on the ear to facilitate clipping the earloop 20 around and behind the ear. In particular, when the earloop is in the static resting state, the snap ring 30 and the behind-the-ear portion 28 are generally lying in the same plane of the earloop. However, because the ear flexes the earloop 20 out of plane when the earloop 20 is worn, the snap ring 30 and the behind-the-ear portion 28 are no longer generally aligned within the same plane. Further, because the earloop 20 also provides a resilient bias between the snap ring 30 and the behind-the-ear portion 28, there is a positive spring action tension exerted by the earloop 20 on the ear that facilitates clipping the earloop 20 around and behind the ear and thus improves the stability of the headset when worn. Accordingly, the ability of the earloop 20 to flex out-of-plane allows the earloop to be worn comfortably and securely.

Although not necessary, the outer portion of the prehensile member 22 preferably generally follows the contour of the inner portion of the prehensile member 22. However, it is noted that the prehensile member 22 preferably has varying thickness along the connecting arm 24 and the behind-the-ear portion 28 and at least the behind-the-ear portion 28 tapers and rounds off both in thickness and in width to facilitate the user in donning the earloop 20 on the ear. The tapering also increases the size at the open end of the open-ended curved space 32 to further facilitate in the user in donning the earloop 20.

Figure 4A:
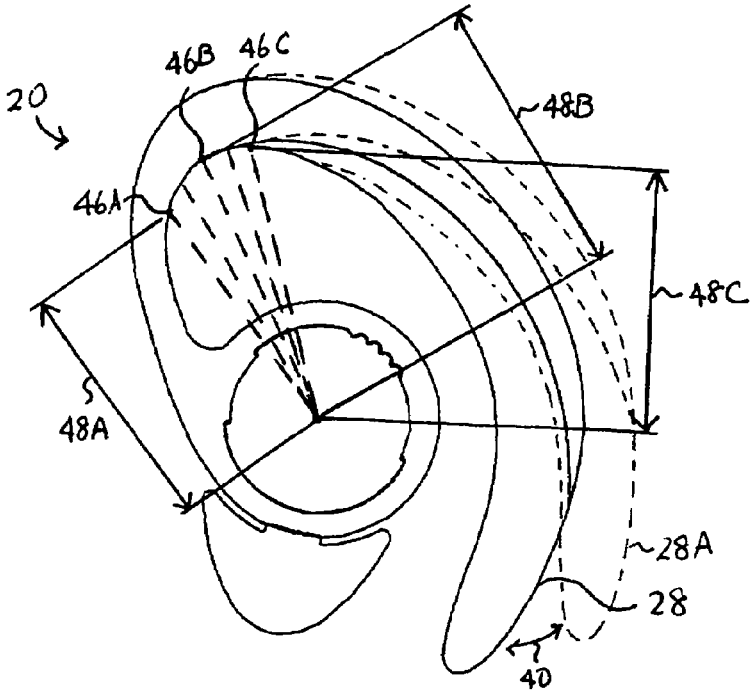
FIG. 4A is a plan view of the earloop of FIG. 1A illustrating built-in adjustment features.
Figure 4B:
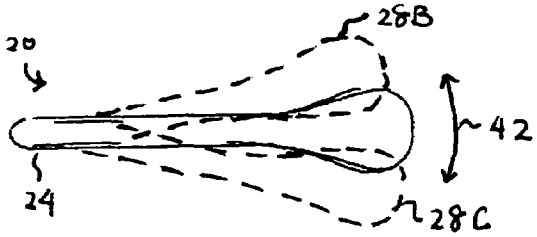
FIG. 4B is a top view of the earloop of FIG. 1A illustrating built-in adjustment features.
Figure 4C:
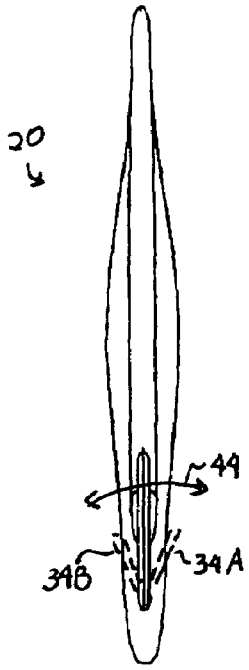
FIG. 4C is a front view of the earloop of FIG. 1A illustrating another built-in adjustment feature.

The earloop 20 is configured to be easily and intuitively donned and doffed. In particular, the earloop 20 provides various built-in adjustment features due to its shape, configuration, dimensions, and/or material of construction. These built-in adjustment features of the earloop 20 will now be described with reference to FIGS. 4A–4C. FIGS. 4A–4C are a plan view, a top view, and a front view, respectively, of the earloop 20 illustrating the various built-in adjustment features.

FIGS. 4A and 4B illustrate two built-in or integrated spring-loaded adjustments, width and lateral adjustments, respectively, provided by the connecting arm 24 of the prehensile member 22. As shown in FIG. 4A, the behind-the-ear stabilizer portion 28 of the prehensile member 22 may be adjusted away from or toward the snap ring 30, as illustrated by arrow 40, so as to increase or decrease the width of the open-ended curved space 32 between the snap ring 30 and the behind-the-ear stabilizer portion 28. Increasing the width of the open-ended curved space 32 enables the user to more easily don or doff the earloop 20. It is noted that the user would typically increase the width of the open-ended curved space 32 by apply an external force to move and position the behind-the-ear stabilizer portion 28A, shown in dashed, away from the snap ring 30. Referring now to FIG. 4B, the behind-the-ear stabilizer portion 28 of the prehensile member 22 may also be adjusted laterally away from the plane of the earloop 20 as shown by arrow 42 and by dashed behind-the-ear stabilizer portions 28B and 28C.

The width and lateral adjustment features provide intuitive don/doff experience to users. For example, the earloop 20 is adjusted only as a result of the process by the user donning or taking off the earloop 20. In other words, the user need not purposely or consciously adjust the earloop in width or laterally when donning or taking off the earloop 20. Rather, the earloop 20 is "automatically" adjusted as the user dons or doffs the earloop 20 as a result of the interaction between the earloop 20 and the user's ear and side of the head as the earloop 20 is donned or doffed. Thus, as these adjustments are the natural result of the earloop 20 conforming to the contours of the ear when the user is putting on or taking off the earloop 20, the external forces applied to the earloop 20 are merely the natural result of the donning or doffing process.

It is noted that the earloop 20 generally returns to its static resting state after external forces are removed. Thus, once the earloop 20 is donned and is resting on the ear of the user, the earloop 20 generally returns to its static resting state. However, depending on the interaction between the earloop 20 and the user's ear and head when the earloop 20 is worn, the user's ear and/or the side of the user's head may prevent the earloop 20 from completely return to its static resting state. In other words, the user's ear and/or the side of the user's head may in effect be applying an external force on the earloop 20 even after the user is no longer actively handling, adjusting, and/or positioning the earloop 20.

The geometry and dimensioning of the earloop 20 contribute to enabling the width and lateral adjustment features. In particular, the connecting arm 24 preferably functions as the hinge for the width and/or lateral adjustment features. The hinge function may be provided at least in part by the connecting arm 24 having a thinner profile than the behind-the-ear stabilizer portion 28 of the prehensile member 22. In addition, the thickness of the prehensile member 22 is preferably continuous, i.e., smoothly transitions or morphs from the thinner connecting arm 24 to the thicker stabilizer portion 28 such that there is no sharp transition between the connecting arm 24 and the behind-the-ear portion 28. When worn, the stabilizer portion 28 is typically situated behind the ear adjacent to the side of the head of the user. Thus, the thicker stabilizer portion 28 also provides added stability to the ear loop when worn so as to further ensure that the earloop 20 is snugly and securely worn on the ear, thereby providing stability and comfort by a wide variety of users.

FIG. 4C is a front view of the earloop 20 illustrating the built-in integrated spring-loaded adjustment of the intertragal notch cover 34. In particular, the optional intertragal notch cover 34 is preferably constructed with an integrated spring design such that the intertragal notch cover 34 can conform to the ear and be deflected off of the plane of the earloop 20 as indicated by arrow 44. For example, when the user is donning the earloop 20, the shape and characteristics of the ear may force the deflection of the intertragal notch cover 34A, 34B (shown in dashed) to one or both sides of the plane of the earloop 20. Thus, the intertragal notch cover adjustment feature is easily and intuitively utilized by the user during the process of donning and taking off the earloop 20.

Referring again to FIG. 4A, the earloop 20 may additionally provide a height adjustment feature when the earloop 20 is worn on the ear. The height that is adjustable is the distance between the center of the snap ring 30 (or the center of the receiver/speaker when the headset body is attached thereto) and the point on the inner surface of the prehensile member 22 that rests on the apex of the ear when the earloop 20 is worn on the ear, as shown by dashed lines extending from the center of the snap ring 30. Points 46A, 46B, 46C are examples of points on the inner surface of the prehensile member 22 that may rest on the apex of the ear when the earloop 20 is donned. When point 46A, 46B, or 46C rests on the apex of the ear, the height is the distance indicated by arrow 48A, 48B, or 48C, respectively. As is evident, the user may rotate the earloop 20 by pivoting about the approximate center of the snap ring 30, relative to the ear and to the headset body (not shown), as illustrated by arrow 50, to adjust the height depending upon size and/or shape of the user's ear. The curved space 32 being open-ended also facilitates such rotation of the earloop 20 with respect to the ear and enables greater flexibility in positioning of the earloop 20 on the ear.

Similar to the width and lateral adjustments described above, the height adjustment is also intuitive and easily made by the user. After placing the earloop 20 onto the ear, the user would rotate the earloop 20 to an orientation that feels most comfortable to the user, i.e., make the height adjustment. By providing this height adjustment, the earloop 20 can be suitably used accommodate a greater number of ear sizes. However, it is noted that the range of height adjustment provided by the earloop 20 may be limited and may be smaller than the range in the corresponding dimension of the ear for potential users. Thus, more than one size of earloop may be provided and offered as options to potential users.

The height adjustment feature is provided by the inner curvature of the prehensile member 22 relative to the center of the snap ring 30. In other words, the distance between the center of the snap ring 30 and the inner surface of the prehensile member 22 varies along the length of the prehensile member 22. As shown, the prehensile member 22 is preferably configured such that its inner surface is not equidistant to the center of the snap ring 30 along the region where the prehensile member 22 may rest on the apex of the ear. Thus, the earloop 20 provides varying height depending upon the particular point on the inner surface of the prehensile member 22 that is positioned to rest upon the apex of the era.

The prehensile member 22 is preferably formed of a single body using any of a number of commercially available, high performance thermoplastics, such as ABS, propylene, Hytrel, Delrin, and/or nylon. It is noted that any other suitable material, preferably with similar properties, may be utilized. The thermoplastic material provides the earloop 20 rigidity and resilient bias for returning to its static resting shape after external applications of forces are removed. The snap ring 30 is preferably integrally formed of the same rigid thermoplastic with the remainder of the prehensile member 22. Although the prehensile member 22 is made of a relatively rigid material, it nonetheless has sufficient flexibility to allow for the width adjustment within the plane of the earloop and for the lateral adjustment out of the plane of the earloop as described above. The flexibility is also achieved by having a reduced cross-sectional area, i.e., thickness and/or width, such as by providing the connecting arm 24, functioning as the hinge for the adjustable features, with reduced thickness, as noted above.

Although a thermoplastic material may be utilized for the entire single-piece construction of the prehensile member 22, at least some of the inner portion of the prehensile member 22 is preferably formed of an elastomer such as Santoprene, Kraton, silicone, Hytrel, or any other suitable material. The optional intertragal notch cover 34 is preferably also formed of the elastomer. However, the intertragal notch cover 34 may alternatively be formed of the thermoplastic material and be integral with and extending from the thermoplastic material of the single piece construction of the prehensile member 22. The elastomer is typically soft, compressible, and/or extensible. As such, the elastomer on the inner portion of the prehensile member 22 provides added comfort and stability to the user as at least part of the inner portion of the prehensile member 22 as well as the intertragal notch cover 34 rest on and may exert pressure against the ear when the earloop 20 is worn. Thus, the softer elastomer for the inner portion of the prehensile member 22 and the intertragal notch cover 34 provides contact surface comfort. In addition, the elastomer may allow some conformity of the inner portion of the earloop 20 to the shape of the user's ear. Moreover, the elastomer typically has a higher coefficient of friction so that the elastomer further facilitates in snug and secure positioning of the earloop 20 on the ear.

Figure 5:
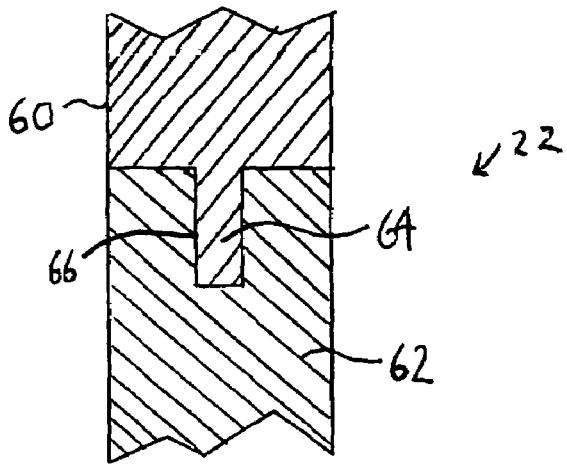
FIG. 5 is a partial cross-sectional view of the earloop made of two materials joined together.
Figure 6A:
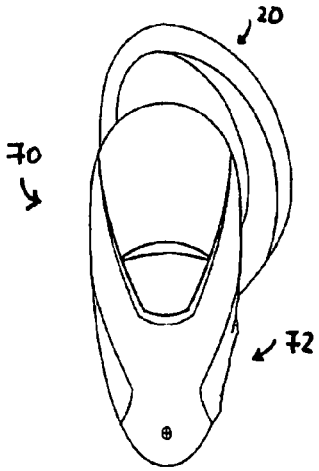
FIG. 6A is a plan view of the earloop of FIG. 1A with a headset body attached in a storage configuration.
Figure 6B:
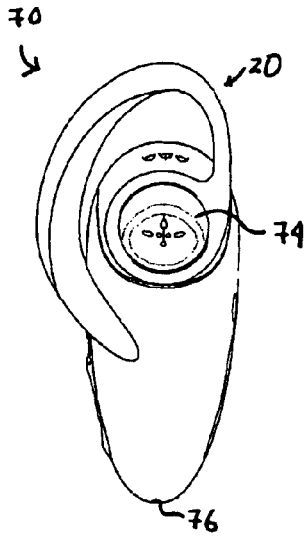
FIG. 6B is a reverse plan view of the earloop and headset body of FIG. 6A in the storage configuration.

In one embodiment, the single piece construction of the earloop 20 may be formed of a single material. Alternatively, the earloop 20 may be formed of multiple materials. FIG. 5 is a partial cross-sectional view of the prehensile member 22 taken along, for example, the end portion of the prehensile member 22 illustrating one preferred embodiment in which a portion of the earloop 20 is formed of two materials. In particular, at least a portion of the prehensile member 22 is comprised of a two-part plastic assembly, preferably a thermoplastic member 60 and a soft and/or compressible elastomer member 62 joined together, as noted above. The two materials are of different chemistries or durometers and may be insert or "dual shot" molded, for example. The thermoplastic member 60 has one or more elastomer capture members or vanes 64 longitudinally disposed along its inner surface. The elastomer member 62 provides a corresponding groove 66 longitudinally disposed along its inner surface. The capture member 64 and the groove 66 are shaped and sized so as to facilitate securing the thermoplastic member 60 to the elastomer member 62. The thermoplastic member 60 may be bonded to the elastomer member 62 using an adhesive, heat, and/or by any other suitable bonding process. Although rectangular cross-sectional shapes are shown for the capture member 64 and the groove 66, it is to be understood that any other suitable shapes, e.g., rounded, trapezoidal, triangular, etc., may be employed As noted above, the earloop 20, and in particular, the snap ring 30, is adapted to receive and secure the headset body thereto. FIGS. 6A and 6B are a plan view and a reverse plan view, respectively, of a headset 70. The headset 70 includes the earloop 20 and a headset body 72, i.e., an audio receiver/transmitter assembly, attached to the earloop 20 and oriented in a headset storage configuration. The headset body 72 includes a receiver capsule 74 and a transmitter/microphone 76. FIG. 6A shows an exterior side (i.e., the side that faces away from the ear when worn) of the headset body 72 while FIG. 6B shows an ear side (i.e., the side that faces the ear when worn) of the headset body 72. As shown in FIG. 6B, the snap ring 30 removably receives and secures the receiver capsule 74 of the headset body 72 to the earloop 20. Preferably, when attached to the snap ring 30, the receiver capsule 74 at least partially extends through the opening in the snap ring 30 such that the receiver capsule 74 at least partially projects toward or into the concha of the ear of the user when worn. When the headset 70 is not being worn on the ear, the headset body 72 may be secured to the earloop 20 and rotated and oriented relative to the earloop 20 as shown in FIGS. 6A and 6B such that the earloop 20 may be clipped and hung onto a stowage carrier, e.g., the clothing of the user. For example, the headset may be stowed by the user by clipping and hanging the earloop onto the outside of the user's shirt pocket.

Figure 6C:
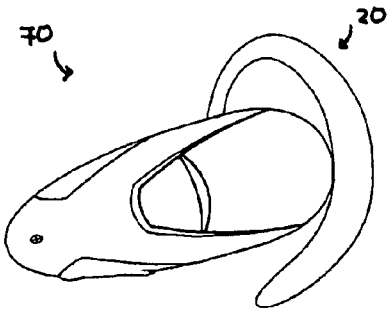
FIGS. 6C and 6D are plan views of the earloop and headset body of FIG. 6A in the usage configuration.
Figure 6D:
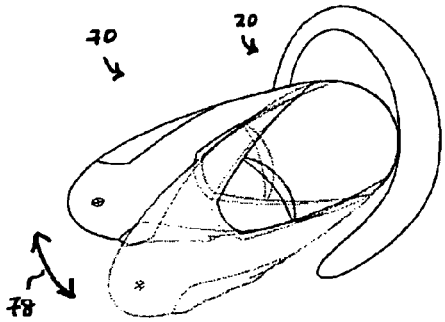
Figure 6E:
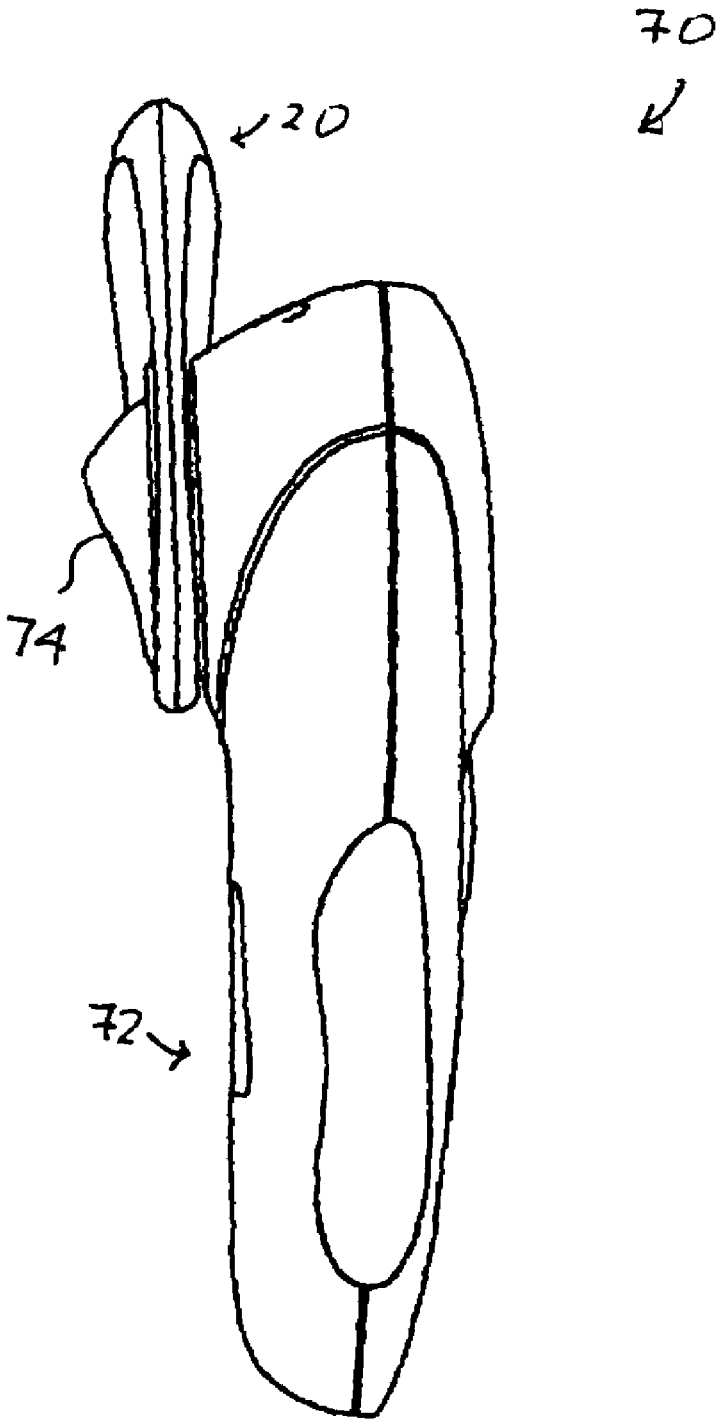
FIG. 6E is a side view of the earloop and headset body of FIG. 6A.

As shown in FIG. 6E, the headset body 72 preferably does not extend beyond or above the curved space defined by the earloop 20 when worn. Rather, the headset body 72 preferably terminates at a location adjacent the curved space between the ring and the prehensile member of the earloop 20. To achieve such a configuration, the receiver capsule 74 generally slopes away from the ear between the ear side and the exterior side of the headset body 72. Such a configuration of the headset body 72 not only facilitates in positioning of the receiver capsule 74 in the concha of the ear as noted above but also facilitates in allowing rotation of the headset body 72 relative to the ring of the earloop 20 as will be described in more detail below.

FIGS. 6C and 6D are plan views of the headset 70 in a usage configuration. As shown, the headset body 72 is secured to the earloop 20 and can be rotated and oriented relative to the earloop 20 as illustrated by arrow 78 in FIG. 6D. In particular, the headset body 72 can be rotated relative to the ring of the earloop 20 with the receiver capsule 74 situated within the ring serving as a general pivot. The rotation and alignment of the headset body 72 relative to the earloop 20 allows the microphone 76 to be properly aligned or angled toward the mouth of the user when worn.

Figure 7A:
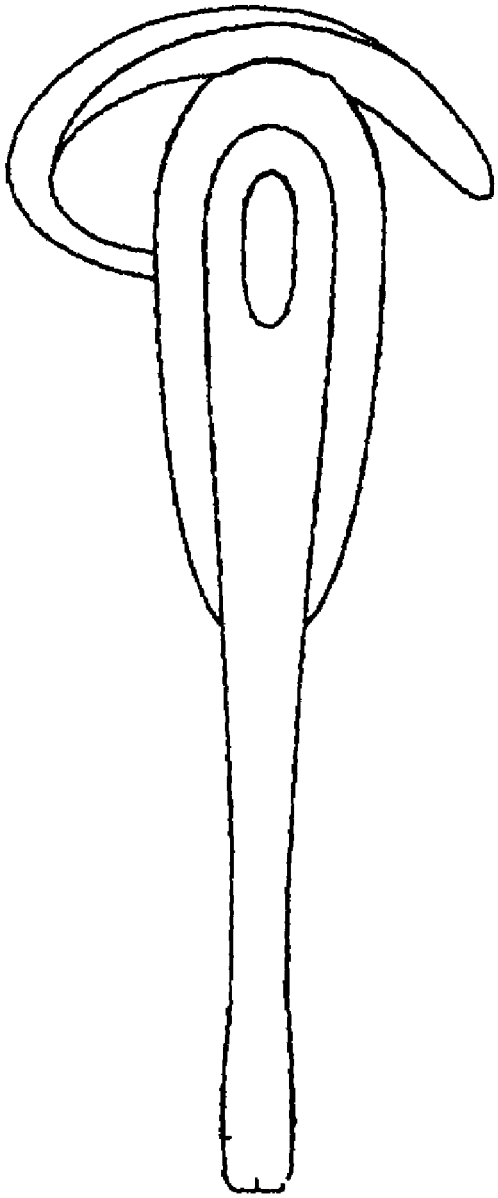
FIGS. 7A and 7B are plan views of headsets with various configurations of headset bodies.
Figure 7B:
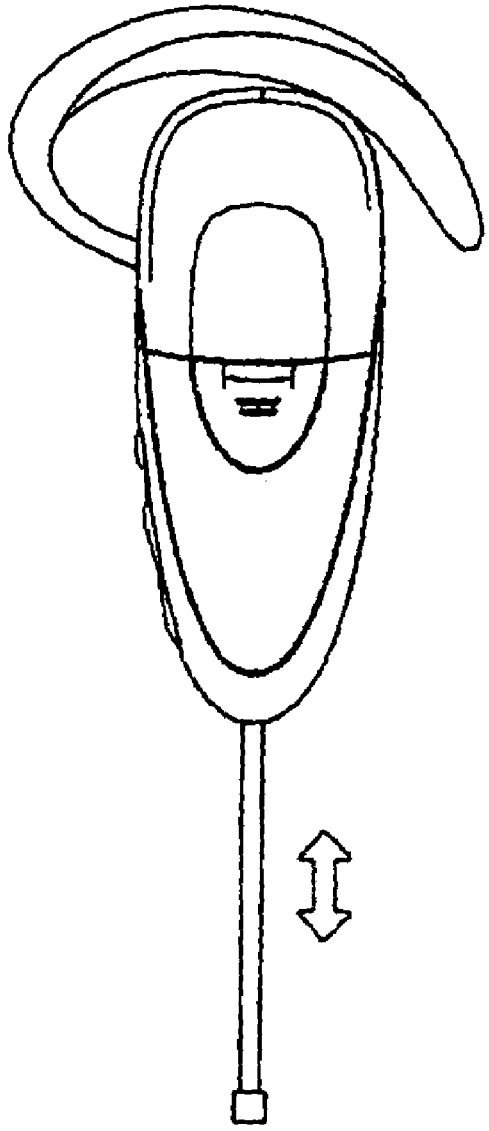

It is noted that although a boomless headset body 72 is shown, any other suitable headset bodies may be utilized. For example, FIGS. 7A and 7B are plan views of headsets with various configurations of headset bodies. In particular, FIG. 7A illustrates a headset body with a long boom and FIG. 7B illustrates a headset body with a retractable boom. Other examples of headset body configurations include stereo headsets or headphones, headset with folding and/or rotating boom, and a boomless headset.

As is evident, the earloop 20 enables the headset 70 to be easily and intuitively donned and taken off the ear. The user can easily rotate the headset body 72 relative to the earloop 20 and don the headset 70 with one hand. For example, the snap ring allows the receiver capsule 74 of the headset body 72 to rotate out of the way as necessary to provide a wider opening for easier donning of the headset 70. The earloop 20 is preferably provided as a one-piece design with a small profile and built-in "automatic" adjustment features. Its simple shape, "automatic" adjustable features, and lack of visible mechanisms for adjustments require little learning by the user and thus provide an easy, intuitive, and ergonomic user interface. Once worn, the headset 70 needs no further adjustments. Moreover, the design of the earloop 20 also provides a simpler design for manufacturing and is thus more cost effective.

In addition, the earloop 20 is comfortable yet snug, secure, and stable when worn. The earloop 20 allows the headset 70 to be clipped around and behind the ear and hung from the ear. The clipping and hanging of the earloop 20 as well as the positive tension (spring action) provided by the earloop 20 improve the stability of the headset when worn. In addition, as the headset is both hung and clipped onto the ear, the pressure from the weight of the headset is more evenly distributed around the ear. Thus, the earloop 20 not only provides an easy and intuitive user interface but also provides improved fit, stability, and comfort.

While the preferred embodiments of the present invention are described and illustrated herein, it will be appreciated that they are merely illustrative and that modifications can be made to these embodiments without departing from the spirit and scope of the invention. Thus, the invention is intended to be defined only in terms of the following claims.

What is claimed is:

1. An earloop for a headset, comprising:

a prehensile member having a connecting member and a prehensile stabilizer portion, the prehensile stabilizer portion being configured to generally extend from approximately the apex of the ear when the earloop is worn on the ear around and behind the ear and adapted to curve and exert a positive tension at least partially around and behind an ear to facilitate clipping the earloop onto the ear in substantially a first plane; and a ring integrally formed with and extending from the connecting member of the prehensile member so as to form a single body therewith, the ring being configured to removably receive and rotatably secure a receiver capsule of a headset therein, the prehensile member and the ring being configured so as to direct the receiver capsule of the headset toward a concha of the ear, the prehensile stabilizer portion being further configured to be resiliently adjustable in a manner selected from the group consisting of: (1) out of the first plane toward or away from the ear when worn on the ear and (2) in the first plane toward or away from the ring, the prehensile member being configured such that a portion of the connecting member approximately near the apex of the ear when the earloop is worn on the ear functions as a hinge to facilitate adjustment of the prehensile stabilizer portion.

2. The earloop of claim 1, wherein the ring is further configured to secure the receiver capsule of the headset in one of two opposing configurations so as to enable the headset to be worn on a left or a right ear of a user.

3. The earloop of claim 1, further comprising an intertragal notch cover coupled to the ring and disposed to at least partially cover an intertragal notch of the ear.

4. The earloop of claim 3, wherein the intertragal notch cover is integrally formed with and extending from the ring so as to form a single body with the ring and the prehensile member.

5. The earloop of claim 3, wherein the intertragal notch cover is resiliently movable out of the first plane toward and away from the intertragal notch of the ear.

6. The earloop of claim 1, wherein at least a portion of the prehensile stabilizer portion includes an elastomeric portion disposed on an inner portion thereof.

7. The earloop of claim 1, wherein the prehensile member and the ring define an open-ended curved space there between to facilitate donning of the earloop on the ear.

8. The earloop of claim 1, wherein the prehensile stabilizer portion is resiliently adjustable out of the first plane relative to the ring toward and away from the ear when worn on the ear upon application of an external force, the prehensile stabilizer portion returning to a static resting state configuration upon removal of the external force.

9. The earloop of claim 8, wherein the connecting member functions as a hinge for the prehensile stabilizer portion when the prehensile stabilizer portion is resiliently moved out of the first plane toward or away from the ear.

10. The earloop of claim 1, wherein the prehensile stabilizer portion is resiliently adjustable relative to the ring in the first plane toward and away from the ring upon application of an external force in the first plane, the prehensile stabilizer portion returning to a static resting state configuration upon removal of the external force.

11. The earloop of claim 10, wherein the connecting member functions as a hinge for the prehensile stabilizer portion when the prehensile stabilizer portion is resiliently moved in the first plane toward or away from the apex of the ear.

12. The earloop of claim 1, wherein the prehensile stabilizer portion has a larger cross-sectional dimension than the connecting member to facilitate at least a portion of the connecting member in functioning as a hinge for resiliently adjusting the prehensile stabilizer portion relative to the ring.

13. The earloop of claim 1, wherein a point along an interior surface of the prehensile stabilizer portion rests on an apex of the ear when the earloop is worn, wherein the point is selected from points along a portion of the interior surface of the prehensile stabilizer portion, wherein points along the portion of the interior surface facilitate in providing adjustability in height between a center of the ring and the apex of the ear.

14. The earloop of claim 1, wherein the ring provides at least one protuberance on an interior perimeter thereof to correspond to and mate with a corresponding channel provided in the receiver capsule.

15. The earloop of claim 1, wherein the prehensile stabilizer portion and the ring are resiliently biased toward each other in the first plane to facilitate clipping of the earloop onto the ear and to distribute weight thereon.

16. The earloop of claim 1, wherein the ring is sized to be generally positioned within the concha of the ear when worn on the ear.

17. A earloop for a headset, comprising:

a prehensile member having a connecting member and a prehensile stabilizer portion, the prehensile stabilizer portion being configured to generally extend from approximately the apex of the ear when the earloop is worn on the ear around and behind the ear and adapted to curve and exert a positive tension at least partially around and behind an ear to facilitate clipping the earloop onto the ear in substantially a first plane; and a ring integrally formed with and extending from the connecting member of the prehensile member, the ring being configured to removably receive and rotatably secure a receiver capsule of a headset therein, the prehensile member and the ring being configured so as to direct the receiver capsule of the headset under a concha wall of the ear, the prehensile stabilizer portion is resiliently adjustable relative to the ring and the connecting member out of the first plane toward and away from the ear upon application of an external force out of the first plane, the prehensile stabilizer portion is further resiliently adjustable relative to the ring and the connecting member in the first plane toward and away from an apex of the ear when worn on the ear upon application of an external force in the first plane, the prehensile stabilizer portion returning to a static resting state configuration upon removal of external forces, the prehensile member being configured such that a point between the connecting member and the prehensile stabilizer portion is approximately near the apex of the ear when the earloop is worn on the ear and functions as a hinge to facilitate adjustment of the prehensile stabilizer portion.

18. The earloop of claim 17, wherein the ring is configured to secure the receiver capsule of the headset in one of two opposing configurations so as to enable the headset to be worn on a left or a right ear of a user.

19. The earloop of claim 17, wherein the ring is further configured to orient and direct a microphone of the headset toward a mouth of a user.

20. The earloop of claim 17, wherein the prehensile stabilizer portion and the ring are resiliently biased toward each other in the first plane to facilitate clipping of the earloop onto the ear and to distribute weight thereon.

21. The earloop of claim 17, wherein at least a portion of the prehensile stabilizer portion comprises an elastomeric portion disposed on an inner portion thereof.

22. The earloop of claim 17, wherein the prehensile stabilizer portion has a larger cross-sectional dimension than the connecting member to facilitate at least a portion of the connecting member in functioning as a hinge for resiliently adjusting the prehensile stabilizer portion relative to the connecting member.

23. The earloop of claim 22, wherein the prehensile member transitions smoothly between the prehensile stabilizer portion and the connecting member to provide comfortable donning of the earloop.

24. The earloop of claim 17, wherein the connection portion functions as a hinge for the prehensile stabilizer portion when the prehensile stabilizer portion is resiliently adjusted relative to the ring and the connection portion.

25. The earloop of claim 17, further comprising an intertragal notch cover coupled to the ring and disposed to at least partially cover an intertragal notch of the ear.

26. The earloop of claim 25, wherein the intertragal notch cover is resiliently movable out of the first plane toward and away from the intertragal notch of the ear.

27. The earloop of claim 17, wherein the prehensile member and the ring define an open-ended curved space therebetween to facilitate donning of the earloop on the ear.

28. The earloop of claim 17, wherein a point along an interior surface of the prehensile stabilizer portion rests on an apex of the ear when the earloop is worm, wherein the point is selected from points along a portion of the interior surface of the prehensile stabilizer portion, wherein points along the portion of the interior surface facilitate in providing adjustability in height between a center of the ring and the apex of the ear.

29. The earloop of claim 17, wherein the ring provides at least one protuberance on an interior perimeter thereof to correspond to and mate with a corresponding channel provided in the receiver capsule.

30. The earloop of claim 29, wherein the at least one protuberance comprises a plurality of teeth adapted to correspond to and mate with another set of teeth provided within the corresponding channel of the receiver capsule.

31. The earloop of claim 17, wherein the ring is sized to be generally positioned within the concha of the ear when worn on the ear.

32. A headset, comprising:

an earloop including:

a prehensile member having a connecting member and a prehensile stabilizer portion, the prehensile stabilizer portion being configured to generally extend from the connecting member approximately near the apex of the ear when the earloop is worn on ear around and behind the ear and adapted to curve and exert a positive tension at least partially around and behind an ear to facilitate clipping the earloop onto the ear in substantially a first plane, and a ring integrally formed with and extending from the connecting member of the prehensile member, the prehensile stabilizer portion being further configured to be resiliently adjustable in a manner selected from the group consisting of: (1) out of the first plan toward or away from the ear when worn on the ear and (2) in the first plane toward or away from the resiliently the prehensile member being configured such that a point between the connecting member and the prehensile stabilizer portion approximately near the apex of the ear when the earloop is worn on the ear functions as a hinge to facilitate adjustment of the prehensile stabilizer portion; and a headset body having a receiver capsule containing a receiver and a transmitter, the ring being configured to removably receive and rotatably secure the receiver capsule of the headset therein, the prehensile member and the ring being configured so as to direct the receiver capsule of the headset toward a concha of the ear.

33. A headset of claim 32, wherein the ring is sized to be generally positioned within the concha of the ear when worn on the ear.

34. A headset of claim 32, wherein the prehensile member and the ring define an open-ended curved space therebetween to facilitate donning of the earloop on the ear.

35. A headset of claim 34, wherein the headset body extends between and terminates at a receiver end and a transmitter end, the receiver end being at a location adjacent the open-ended curved space when worn on the ear.

36. A headset of claim 32, wherein the headset body can be oriented and directed relative to the ring so as to position the transmitter of the headset in a direction toward a mouth of a user.

37. A headset of claim 32, wherein the headset is configurable to be in a stowage configuration, the stowage configuration being such that the prehensile member is oriented relative to the headset body to facilitate clipping of the earloop onto a stowage carrier and having the headset body portion being oriented generally vertically downward when the earloop is clipped onto the stowage carrier.

38. A headset of claim 32, wherein the prehensile stabilizer portion is resiliently adjustable relative to the ring and the connecting member out of the first plane toward and away from the ear upon application of an external force out of the first plane, the prehensile stabilizer portion returning to a static resting state configuration upon removal of the external force.

39. A headset of claim 32, wherein the prehensile stabilizer portion is resiliently adjustable relative to the ring and the connecting member in the first plane toward and away from an apex of the ear when worn on the ear upon application of an external force in the first plane, the prehensile stabilizer portion returning to a static resting state configuration upon removal of the external force in the first plane, the prehensile stabilizer portion returning to a static resting state configuration upon removal of the external force.

* * * * *